United States Patent [19]

Kosrow et al.

[11] 4,086,860

[45] May 2, 1978

[54] EDGE ALIGNMENT APPARATUS

[75] Inventors: Robert L. Kosrow, Hoffman Estates; Alfred W. Bohl, Wauconda, both of Ill.

[73] Assignee: Union Special Corporation, Chicago, Ill.

[21] Appl. No.: 686,354

[22] Filed: May 14, 1976

[51] Int. Cl.[2] ..... D05B 35/10

[52] U.S. Cl. ..... 112/153; 271/227; 112/207

[58] Field of Search ..... 112/153, 121.11, , 207, 112/203; 271/226-228; 250/560, 561

[56] References Cited

U.S. PATENT DOCUMENTS

| | | | |
|---|---|---|---|
| 3,867,889 | 2/1975 | Conner, Jr. | 112/121.11 |
| 3,889,614 | 6/1975 | Nicolay et al. | 112/153 |
| 3,903,820 | 9/1975 | Kleinschmidt et al. | 112/153 |
| 3,954,071 | 5/1976 | Mall et al. | 112/207 |

*Primary Examiner*—Werner H. Schroeder
*Assistant Examiner*—Peter Nerbun
*Attorney, Agent, or Firm*—John W. Harbst; John A. Schaerli

[57] ABSTRACT

Frame including at least one: gripper, sensor and an orientating device. In response to the sensor, the gripper selectively secures independent material sheets. The orientating device then positions the material sheets in a predetermined manner.

11 Claims, 10 Drawing Figures

5

103
105
157
155
129
131
139
137
64
213
215
243
241
211
209
113a
144
TABLE TOP
65
5

107

187
187
115
111a
113a
105
113
129
131
111
157
215
243
213
137
209
103
127
125
127
117
64
187
187
100
65

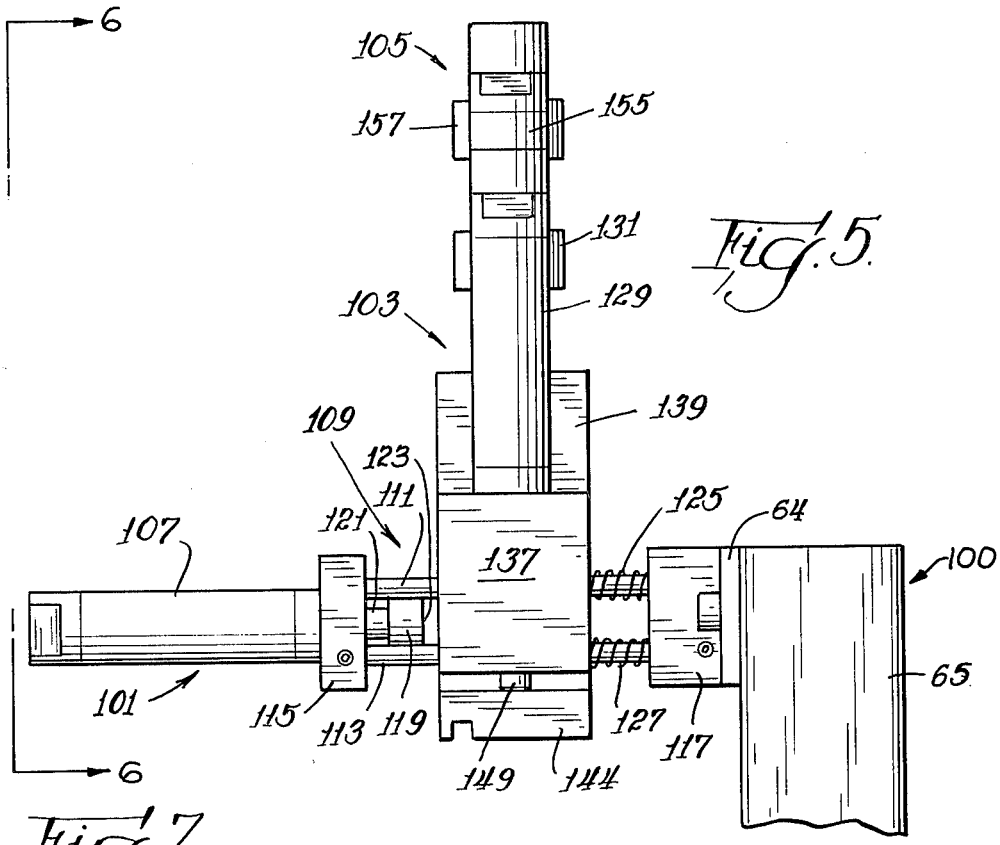
Fig. 5.
Fig. 7.
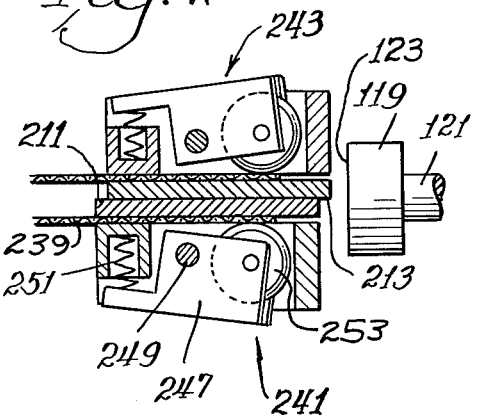
Fig. 6
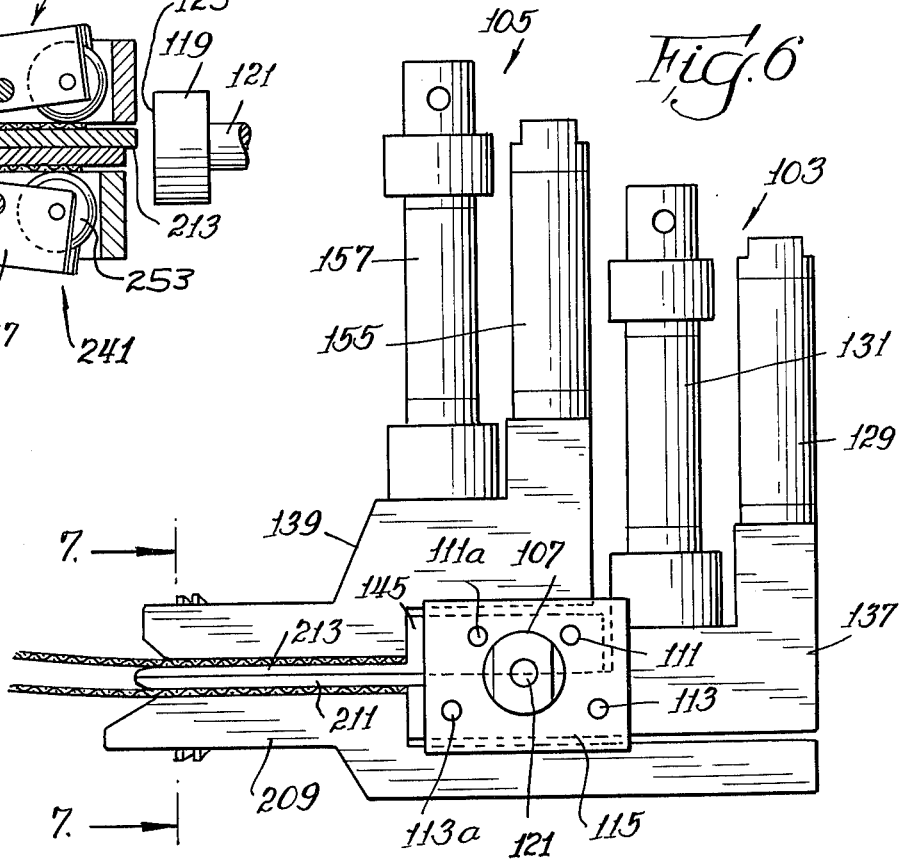

157
155
163

243
165
177
187
117
229
185
125
139
129
131
179
255
183
189
153
149
233
111
145
191
201
213
207
219
173
217
175
211
127
113a
137
205
193
153
115
195
203
183
181
171
141
209
227
107
119
121
251
241

EDGE ALIGNMENT APPARATUS

This invention relates to an apparatus for seaming or joining fabric plies and more particularly to an automatic means which senses and aligns in a predetermined manner the edges of a series of fabric plies.

In a substantial number of sewing operations, such as the construction of pants, shirts, etc., it is necessary to perform a particular sewing function. This function is the stitching of one or more plies of material together along a line parallel with, and spaced inwardly from, the edges of the material assembly. An additional problem of the function of the process is the matching of the top and bottom edges of the fabric plies. That is, it is necessary to match the start and finish ends of the two pieces so they are even. This latter function is complicated in the fact that the cutting department, due to error, inadvertence, etc., may often produce these "same" size panels, which in reality are of different lengths. In regard to the former of these problems, that is edge guiding or material alignment with respect to a longitudinal edge, a substantial number of devices are available. Among these are Winberg U.S. Pat. No. 3,434,439 and another patent to Winberg, et al U.S. Pat. No. 3,722,437. A patent relating to a device for sensing the out of registration condition of the trailing ends is one to Conner, Jr. U.S. Pat. No. 3,867,889.

The side seaming and end alignment are for the most part to date performed in conjunction with at least some manual steps. That is, the operator may manually both guide the edge and align the bottom edge. In one operation she first aligns the top edge of the fabric panels, inserts these under the presser foot and thereafter guides the fabric plies to follow the contour. Simultaneously while she is guiding the fabric panels, she is tensioning one or the other of the fabric panels to either stretch it or change its normal feed rate. As a result of this manual expertise the operator will produce substantially aligned bottom edges.

The invention hereunder consideration includes a means for positioning fabric panel means in a predetermined state. In the particular embodiment as shown, the fabric panel alignment means is combined with a guiding apparatus to do side seamings on such things as trouser panels, shirt, dress, slack or jacket parts. One embodiment of the alignment means comprises; clamping or gripping means for each of the fabric plies, sensor means capable of detecting a predetermined condition of the fabric plies, and a force transfer means capable of aligning the ends of the fabric plies in said predetermined position in response to input from said sensors.

In the particular environment of the edge alignment means, as shown inhere, the overall device is generally designed to side seam pants panels or side seam shirt parts. This particular environment includes a series of loading clamp assemblies which secure and deliver the pants panels; for example, to the sewing head. Adjacent the sewing head is an edge guide means which position the edge of the fabric plies in a predetermined position with respect to the sewing instrumentality, i.e., the needle. As is apparent, the feed mechanism, the feed dog means of the sewing machine pull the fabric past the sewing instrumentality while the edge guide means follows the particular contour of the fabric panel and maintains the proper predetermined position. During the initial stages of this operation, the fabric alignment means aligns particular edges of the fabric panel in a predetermined manner.

It is therefore, an object of this invention to provide a means which aligns particular edges of fabric panels in a predetermined position. Yet another object of this invention is to provide a machine for performing a side seam operation on a series of fabric panels in which the bottom corners are automatically positioned in a predetermined manner. Still another object of this invention is to provide a means which clamps a series of fabric plies adjacent the ends thereof, determines the location of the ends, and then aligns the ends in a predetermined position. Another object of this invention is to provide an end sensing means which can align the bottom side edge and bottom end of a series of fabric panels at the initial stages of the side seaming operation as well as during the side seaming operation. Another object of this invention is to provide a means for aligning, in a predetermined manner the bottom edge and the side edges of a series of fabric panels and then follow said fabric panels during the side seaming operation to a position directly in front of the stitch forming instrumentality. Yet another object of this invention is to provide an edge and end alignment means which initially engages the fabric panels at a midpoint thereof and sweeps down to the lower corners. Still another object of this invention is to provide an alignment means capable of aligning the ends of fabric plies in a predetermined position at the beginning of an operation at several predetermined points during the operation or continuously during the operation. Yet another object of this invention is to provide an assembly means which initially engages the fabric panel means at a midpoint thereof and sweeps up to the top corner.

The above description as well as further objects, features and advantages of the present invention will be more fully appreciated by reference to the following detailed description of an embodiment in conjunction with the accompanying drawings, wherein:

FIG. 5 is a fragmentary transverse section taken along lines 5—5 of FIG. 3;

FIG. 6 is a side elevational view of the subject device taken along the lines 6—6 of FIG. 5;

FIG. 7 is a cross-sectional view taken along the lines 7—7 of FIG. 6;

Figure 1:
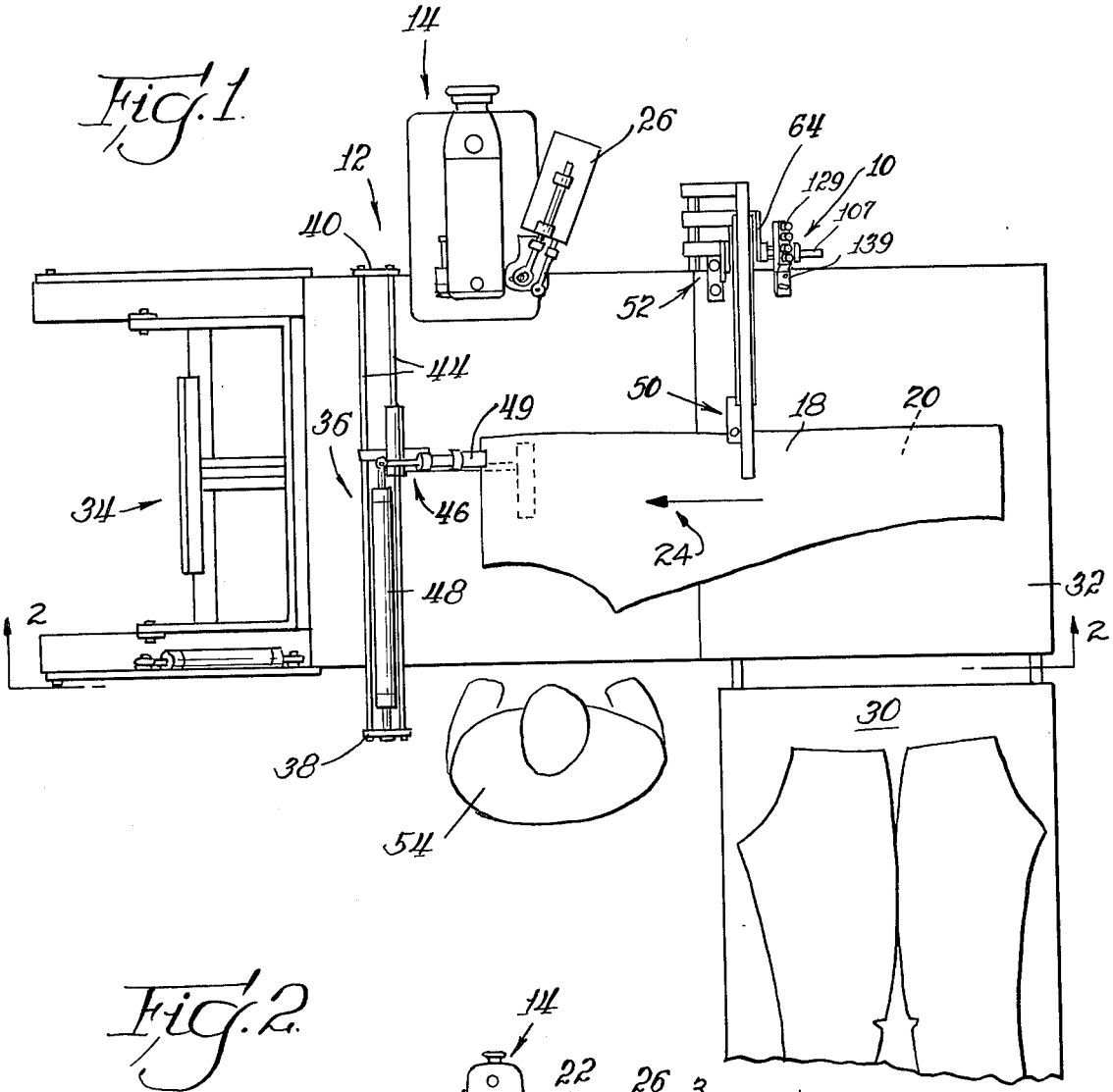
FIG. 1 is a plan view of a contour seamer assembly with the fabric panels in position to begin the initial sequence of events.
Figure 2:
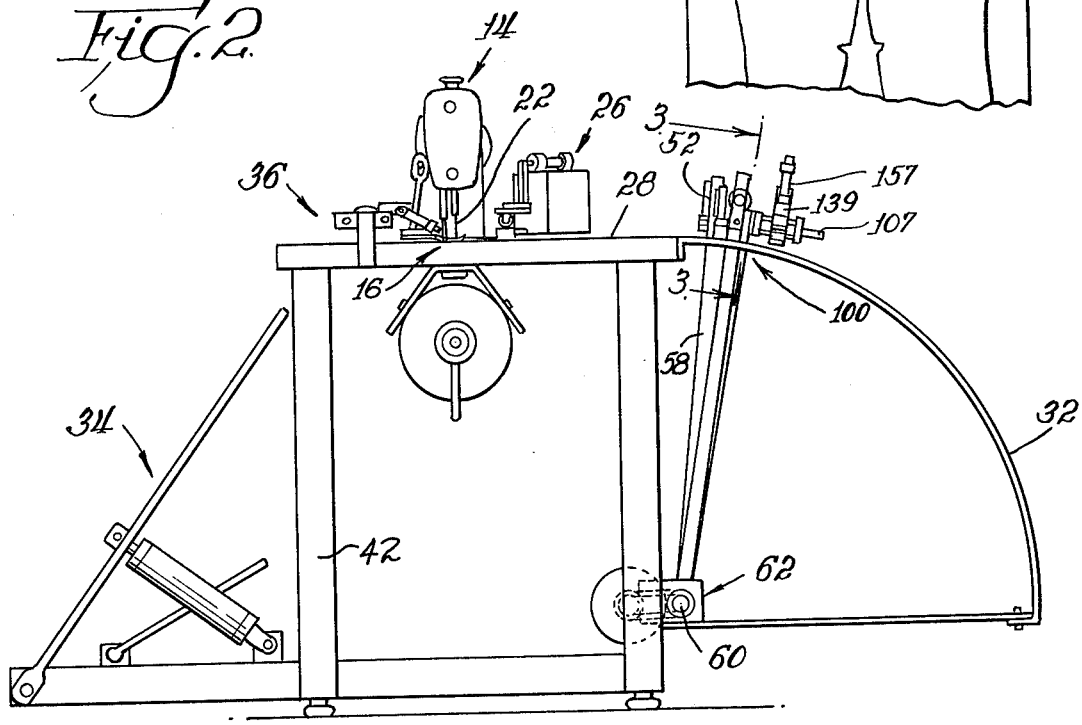
FIG. 2 is a side view of the apparatus of FIG. 1 taken along the lines 2—2 of FIG. 1.

Referring now to the drawings, and more particularly to FIGS. 1 and 2, there is shown generally an apparatus for joining together two pieces of material and in combination therewith is one embodiment of the fabric aligning means 10. The particular combination in which the fabric aligning means 10 is herein incorporated is referred to generally as a contour seaming assembly designated as 12. The contour seaming apparatus 12 is normally employed for the joining of two pieces, for example, pants panels along their respective edges. Included in the combination is a sewing machine means 14 of a commercially available type, such as manufactured by the Union Special Corporation and identified as Style 56300. It should be noted that the sewing machine means 14 is provided with top and bottom ply feed means 16. These feed means 16 move the two respective plies of fabric material such as 18 and 20 past the stitch forming instrumentality or needle 22 at a generally uniform rate. As shown in FIG. 1 the feed of material is from the right to the left as indicated by the arrow means 24.

To the right of the sewing machine 14 is a fabric guiding means 26 which guides automatically the two pieces of fabric into the sewing machine for the subsequent stitching together thereof. Such automatic guiding means are known in the art as evidenced by the patent to Conner U.S. Pat. No. 3,636,898 and thus no further detail will be given thereon. Briefly, however, the feed dogs or feed means 16 of the sewing machine 14 pull the fabric plies 18 and 20 past the needle means 22. Simultaneously therewith the guide means 26 automatically positions the fabric back and forth in compliance with the general contour of the side edge of the fabric such that a line of stitches is produced at a uniform predetermined distance from the side edges thereof. For a complete understanding of the guide means 26 herein employed, reference should be made to the above identified Conner patent.

A horizontally extending table top means 28 is provided to support the plies of the textile fabric means 18 and 20 during the work cycle. An additional or second table means 30 is provided adjacent thereto as a material storage means. The table top means 28 has a curved portion 32 in the preferred embodiment which allows the fabric panels to be handled in cooperation with the pull of gravity. The employment of the curved portion 32 also allows the construction of an overall contour seamer apparatus which occupies less space than a device which employed a table top which was generally horizontally extending over its entire area. It will be appreciated however, that the particular design of the table is not a critical feature but rather simply one component of the embodiment in which the invention is incorporated.

To the rear of the overall contour seamer apparatus is a stacking apparatus means 34. The stacking apparatus 34 can be of any convenient or appropriate design and simply facilitates the general automation of the process.

Another element in the overall combination of the contour seamer means is the top or loading clamp assembly means 36. The top clamp assembly means 36 includes suitable support means such as brackets 38 and 40 which are secured to the frame 42 of the table means 28. Extending between the brackets are guide rod means 44 which carry the clamping brackets 46. A force transfer means is employed to slide the clamping bracket means 46 along the guide rod means 44. In the preferred embodiment the force transfer means 48 is a pneumatic cylinder. The clamping bracket 46 in the preferred embodiment includes a series of jaw means 49 into which the aligned top corners of the fabric panels are inserted. The jaw means are then closed and held in this position by any suitable means.

As shown in the embodiment of the contour seamer means 12 in FIG. 1, an intermediate or transfer clamp means 50 is provided to work in conjunction with the top clamp assembly 36 to load the fabric panels 18 and 20 for the performance of the work cycle thereon. The particular design of the transfer clamp means 50 can be of a nature similar to that of the top clamp assembly 36. That is, including guide rods, pneumatic cylinder and clamping jaw means. The primary purpose of the transfer clamp means is to move the fabric plies 18 and 20 across the table top 28 and load them into a midpoint clamp means 52 and the alignment clamp means 10. It should be noted that during the normal work cycle of the contour seamer assembly 12, both the top clamp assembly 36 and the transfer clamp assembly 50 move the material to the position suitable for the start of the sewing cycle. Both assemblies then move back to the position shown in FIG. 1 where the operator, such as 54, can load or position a second series of pants panels while the actual contour seaming and alignment position of the cycle is being performed. This allows a substantially rapid overall contour seaming operation to be achieved. That is, the contour seaming operation is being performed at one station while the next series of panel plies are being loaded.

During the work cycle of this particular contour seamer assembly, the midpoint clamp means 52 follows the material to the left. The midpoint clamp means 52 thereof being designed to maintain the alignment as originally determined by the operator upon loading initially into the transfer clamp 50, to a point directly in front of the needle means 22. In order to accomplish the following of the midpoint clamp 52, the clamp is mounted on a support means 58 which is pivoted around point 60 by a torque motor 62. As is apparent, the torque motor moves the assembly 58 at such a rate just sufficient to keep tension in the fabric plies 18 and 20. The alignment clamp means 10 is carried in a similar support assembly 100, that is on an elongated bracket means 64 and rod means 65 which are connected generally at a right angle and are pivoted around point 60. The support assembly 100 is also driven through its cycle by torque motor means 62. The linkage, however, between torque motor 62 and alignment means 10 is such that at the initial stages of the work cycle, that is, after the fabric means 18 and 20 have been loaded into both the midpoint clamp means 52 and the alignment clamp means 10, the alignment clamp 10 is driven to the right as shown in FIG. 2. That is, it sweeps down the side edges of the fabric means 18 and 20.

Figure 3:
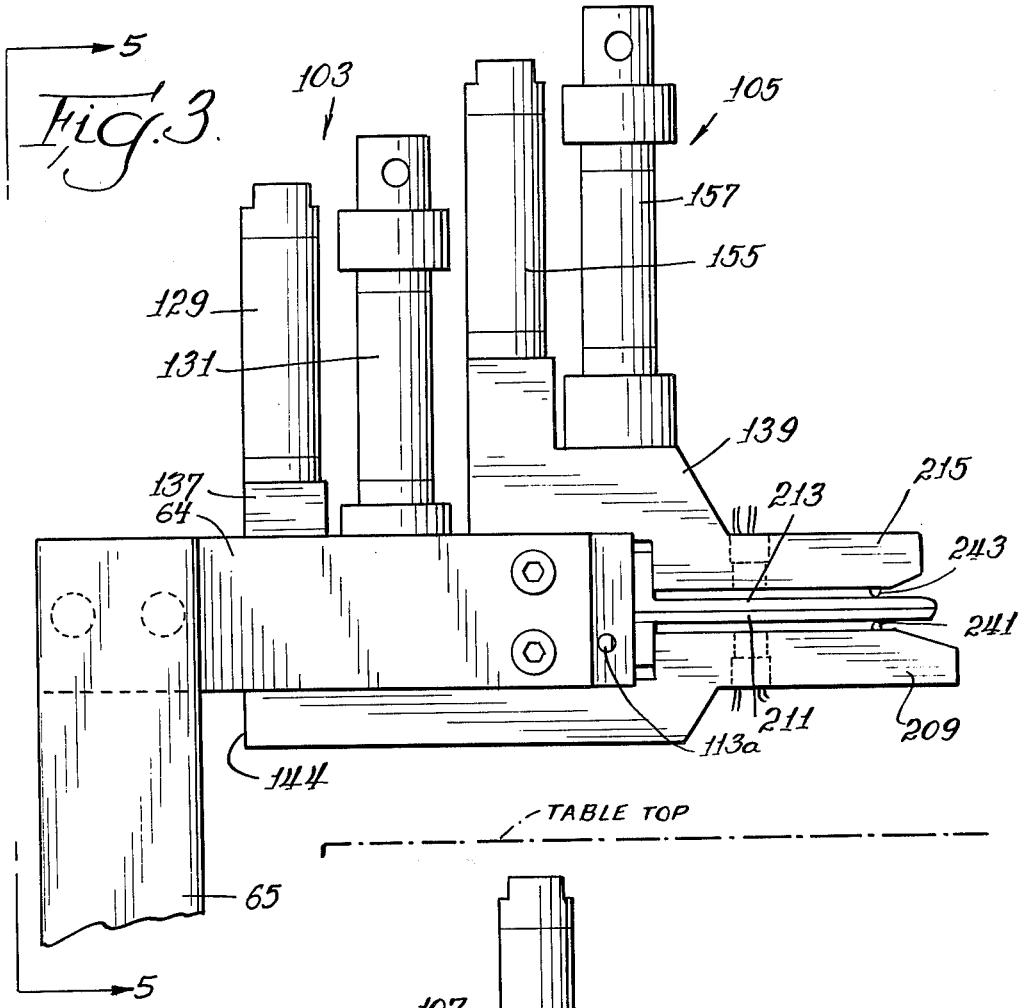
FIG. 3 is a partial side view of the alignment means taken along the lines 3—3 of FIG. 2.

Referring now to FIGS. 5 through 10, there is shown one embodiment of the alignment assembly means 10 as herein disclosed. FIG. 5, as will be appreciated from a consideration of FIG. 3, is a view from the rear of the edge alignment means. The support assembly means 100 has been previously discussed and therefore will not be discussed further here.

As shown in the embodiment, there are a series of force transfer means 101, 103, and 105. These force transfer means are carried by and act upon different portions of the end alignment means. The force transfer means 101 in the embodiment, as shown, constitutes a pneumatic cylinder means 107 carried on a support system 109. As is apparent, other means could also be suitably employed, such as direct current motors, stepper motors, etc. The support system 109 includes a series of rod means such as 111 and 113 which slide freely, to interract in a sliding manner with the other elements of the end alignment means. The respective ends of the rod means 111 and 113 are secured to block means 115 and 117. As is shown in FIG. 5, block 117 is secured to support means 100.

Figure 4:
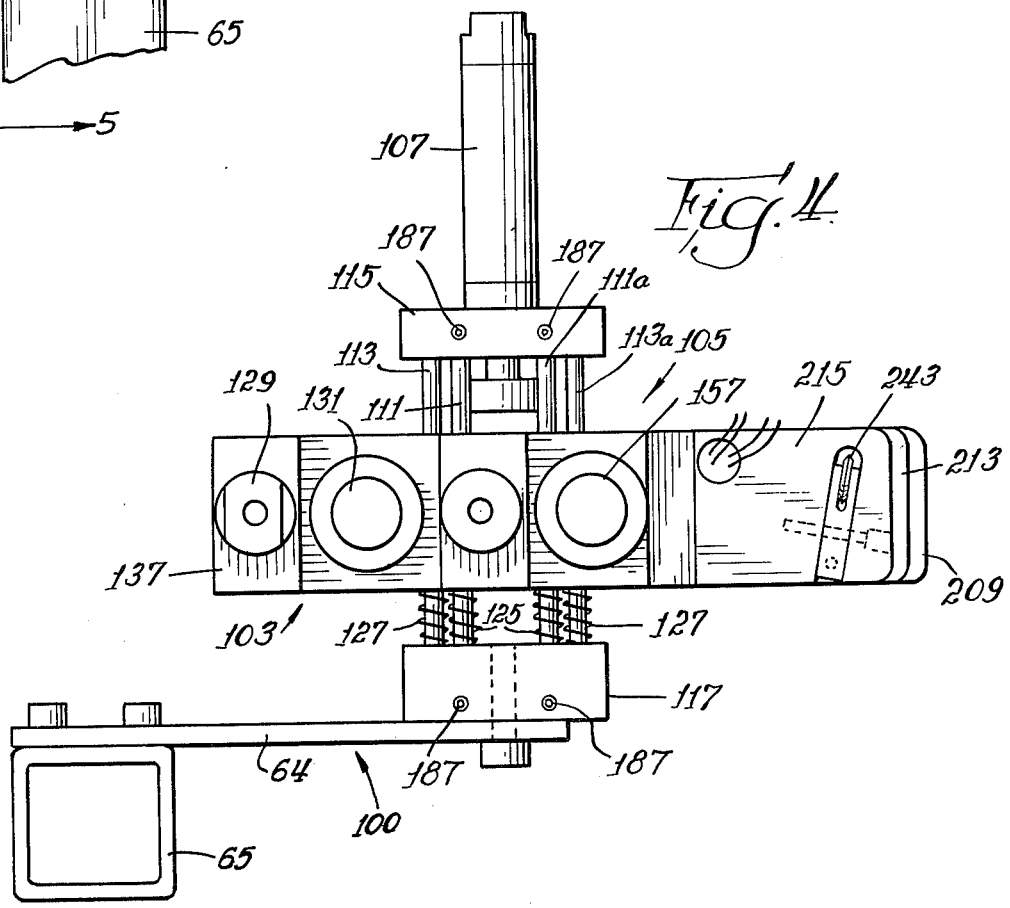
FIG. 4 is a top view of the alignment means and its supporting means as shown in FIG. 3.
Figure 8:
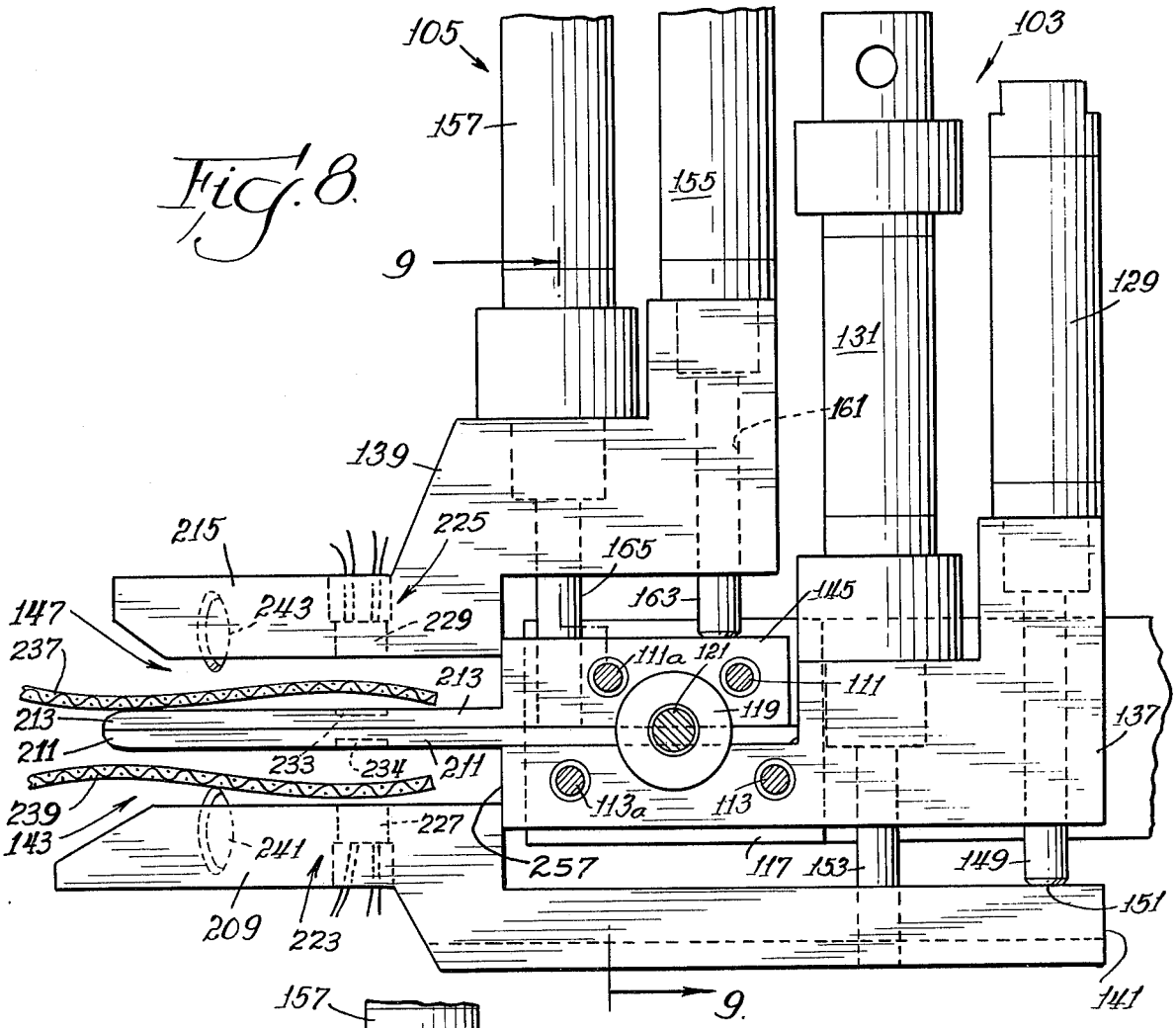
FIG. 8 is a cross-sectional view taken along the lines 8—8 of FIG. 9.

The pneumatic cylinder 107 has its frame secured to the block means 115. An aperture means 171 within the frame allows the rod means 121 of the pneumatic cylinder to pass therethrough. The end 119 of the rod 121 is capable of contacting and delivering force to particular elements of the edge alignment means upon actuation of the force transfer assembly means 101. As will be more fully explained and from a brief consideration of FIGS. 6 and 7 it will be apparent that the face 123 of the rod means 121 contacts at least two different groups of elements which comprise the alignment means. As force is transferred thereto, the elements are brought into alignment against the flat face 123 of end 119. As shown in FIG. 8, there are in fact two sets of support rods, that is in addition to support rods 111 and 113 there are support rods 111*a* and 113*a*. As will be seen in FIGS. 4, 5 and 9, a first and second spring means 125 and 127 journal the supporting rods and exist in a state of compression between the support block 117 and particular elements of the alignment means. Thus, it is apparent that any movement by the force transfer means 101, and more particularly the movement of the rod means 121 to the right as shown in FIG. 5, a force in the opposite direction will be created by the spring means 125 and 127.

Referring now to FIG. 6 and to force transfer means 103 and 105, in the embodiment as shown, these force transfer means include a series of pneumatic cylinder means. The pneumatic cylinder means 129 and 131 are associated with force transfer means 103 and the pneumatic cylinder means 155 an 157 are associated with the force transfer means 105. Cylinder means 129 and 131 have their frame means secured to support means 137. Pneumatic cylinder means 155 and 157 have their frame means secured to support means 139. As will be hereafter more fully appreciated, the support means 137 and 139 in response to the application of force from force transfer means 101, 103 and 105 are capable of moving in different planes, independent of each other. Referring now to FIGS. 6 and 8 in combination, it will be appreciated that support means 137 in conjunction with support means 141 are elements of an automatically positionable clamping means 143. It should also be appreciated that support means 139 in combination with support means 145 form a second clamping means 147. This is also automatically movable to predetermined positions. As shown in FIG. 8, the end 151 of the rod means 149 of pneumatic cylinder means 129 is normally in an abutting relationship with support means 141. Thus, upon actuation of pneumatic cylinder means 129, the support means 137 and 141 will be forced apart. The pneumatic cylinder means 131, as previously stated, also having its frame secured to the support means 137 has its rod means 153 securely connected to support means 141. Any particular method, such as thread engagement, press fit, etc., may be employed to accomplish this connection. In the embodiment as shown, the pneumatic cylinder means 129 is a single acting cylinder and pneumatic assembly means 131 is a double acting cylinder. Thus, it will be appreciated, upon the actuations of cylinder means 129 and 131, the support means 137 and 141 can be selectively clamped and opened.

The force transfer means 105 includes a single acting pneumatic cylinder means 155 and a double acting pneumatic cylinder means 157. The rod means 163 of pneumatic cylinder 155 passes through an aperture 161 in support means 139, such that the end means contacts support means 145 in an abutting relationship. As is apparent, the frame of pneumatic cylinder means 155 is fixedly secured to support means 139. Also having its frame means fixedly secured to support means 139 is double acting cylinder means 157. Here also the rod means 165 passes through an aperture means 167 to be securely connected to support means 145. This combination of elements from the second automatically controllable clamping or jaw means 147. From a consideration of FIG. 8, it will be apparent that the end 119 of the rod means 121 of force transfer means 101 contacts both the first automatically controllable clamping means 143 as well as the second 147.

Figure 10:
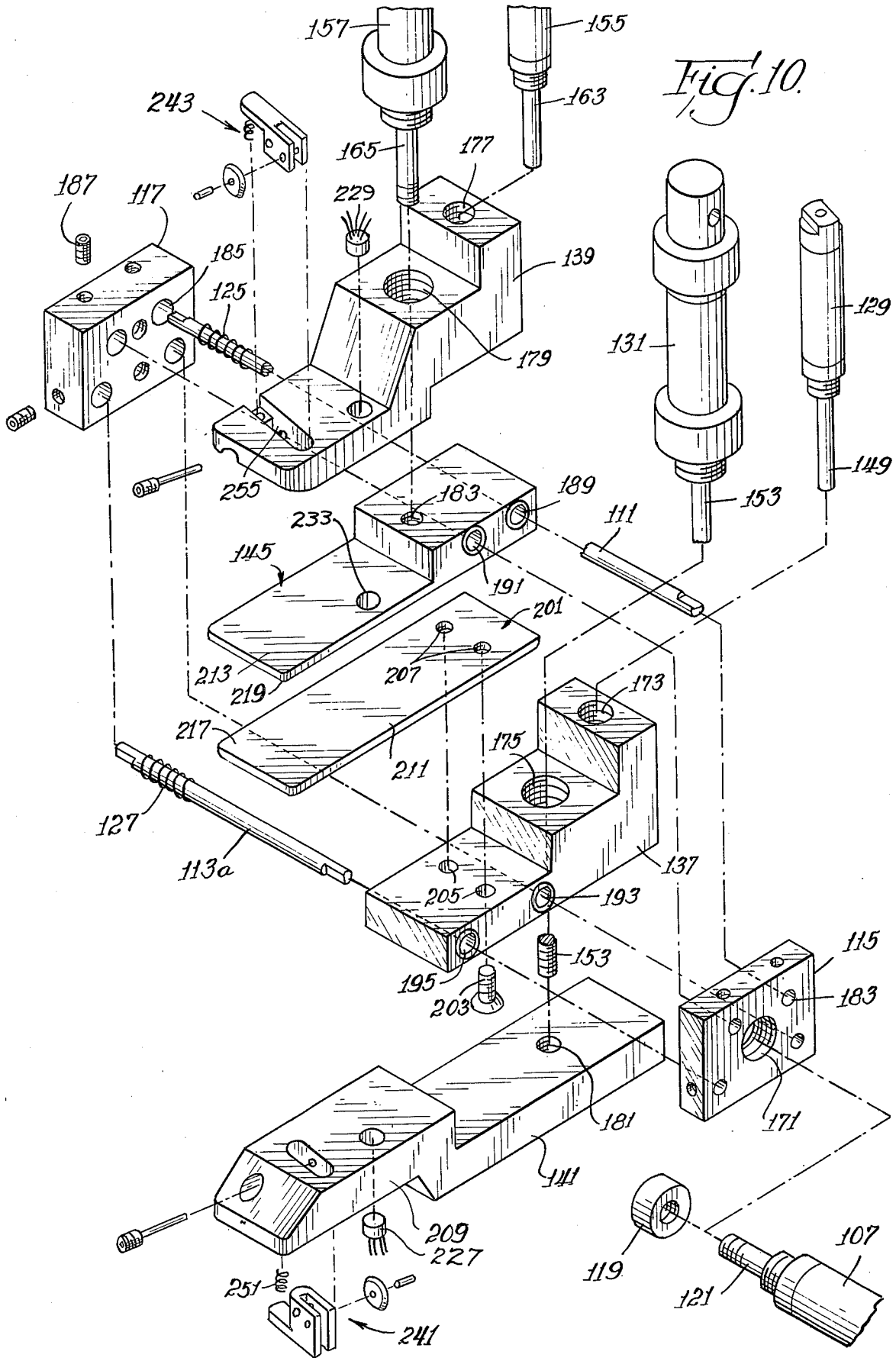
FIG. 10 is an exploded view of one particular embodiment of the invention of this application.

Referring now to FIG. 10 wherein is shown an exploded view of the alignment means, the pneumatic cylinder means 107 has its frame threadedly secured to the support means 115 via aperture means 171. The same is true for the frame of pneumatic cylinder means 129, 131, 155 and 157. The threaded apertures 173, 175, 177 and 179 are provided to allow a threaded engagement therewith. The threaded hole 181, in support means 141, is provided to receive the end 153 of pneumatic means 131 while the threaded hole 183 in support 145 receives the end of rod 165 of pneumatic cylinder means 157.

Figure 9:
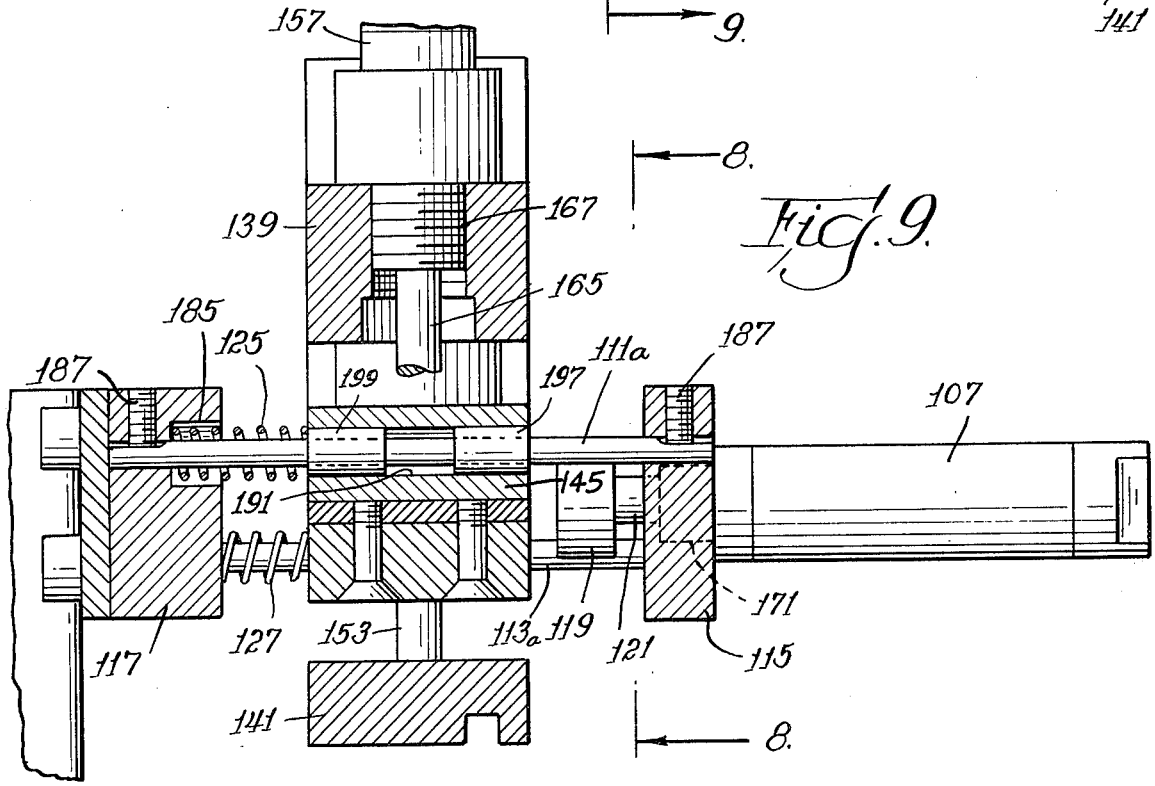
FIG. 9 is a partial cross-sectional view taken along the lines 9—9 of FIG. 8.

In discussing the support rod means; namely, 111, 111*a*, 113 and 113*a*, only 111 and 113*a* will be discussed in conjunction with FIG. 10. As is apparent, what applies to one of the rods in the set will apply equally well to the other. The support rod 111 has a first end journaled in an aperture 185 in support means 117. A plurality of set screws, such as 187, are employed to securely connect each rod to the corresponding support means. A series of aperture means 189 and 191 are provided in support means 145, and a second substantially identical set of aperture means 193 and 195 are provided in support means 137, allowing for passage of said support rods therethrough. Referring now to FIG. 9 there is shown a cross-sectional view of the support means 145 clearly depicting the aperture means 191. As viewed in FIG. 9, on the right and left sides respectively of support means 145 are sleeve bearing means 197 and 199, which are press fit within the aperture 191. The bearing means 197 and 199 are provided to limit the amount of friction between the support rods respectively which combine to form the jaw sets 143 and 147. Thus, as is apparent, the first and second clamping means assemblies 143 and 147 are capable of independent movement with respect to each other in a vertical plane and yet can be positioned in a predetermined mode in a horizontal plane with respect to each other by a single force transfer means, namely force transfer means 101.

As shown in FIGS. 8, 9 and 10, plate means 201 is securely connected to main support means 137. This connection can be via a press fit means or; for example, a screw means, such as 203, passing through aperture means 205 being threadably engaged in a threaded aperture 207 may be employed. As previously stated, support means 139 and means 145 are fixedly connected via the end of rod means 165. Referring to FIG. 8, it will be noted that the front portion means 209 of support means 141 and the front portion means 211 of plate means 201 lie paralled and co-extensive with each other. As has been previously stated by virtue of the transfer means, it is these end portions, 209 and 211, which form the gripping portions of the automatic clamping means 143. The other automatic clamping means 147 includes the forward portion 213 of support 145 as well as the forward portion 215 of support means 139.

The abutting surfaces 217 and 219 of end portions 211 and 213 respectively, are worked such that a minimal amount of friction exists therebetween. Thus, in the relationship as shown in FIG. 8, each can move in or out of the major plane of the paper as shown, with a minimum amount of resistance.

Each of the clamping or jaw means 143 and 147 is provided with its own independent fabric sensor means 223 and 225. As can be appreciated, any type of sensor means can be employed as long as it is capable of sensing the absence, the partial absence or a particular feature of the subject fabric ply. At this point it must be repeated that it is within the scope of the invention to align sheet material other than fabric plies. Depending on the nature of this material, various types of sensors could be employed which could sense various features thereof. All of these parameters become evident once the nature of the invention hereunder consideration is grasped.

In the preferred embodiment for manipulation with fabric material, 10 element photo transistor card reader array means 227 and 229 are placed in support means 209 and 215 respectively. Associated with the array means 227 is a light source 234 carried on the bottom portion of end means 211. A second light source means 233 cooperates with array means 229 and is located in the top portion of end means 213. It is thus apparent that when two fabric plies such as 239 and 237, as shown in FIG. 8, are inserted between the respective clamping or jaws 143 and 147, the shorter of the two will be the first to actuate its respective array means.

A side edge guide means 241 and 243 are additionally provided to insure that the side edges can be accurately and automatically positioned with respect to each other in a predetermined mode. The side edge alignment means 241 and 243 are shown in FIG. 7. It should be appreciated that this is only one particular embodiment. Additionally it will be appreciated that both of the side edge guide means 241 and 243 are identical with respect to each other. Therefore, only one device will be explained with the understanding that it applies equally as well to the other. Referring now to side edge alignment means 241, it comprises a frame means 247 pivotally mounted at 249. A spring means 251 continuously urges the guide wheel means 253 into engagement with the fabric means 239 as shown. A slot means 255 is cut, the particular angle being whatever desired, in the respective support plate. It is this angle and the strength of spring means 251 which will determine how fast and with what force the fabric 239 is urged against the guide wall 257.

Referring now to a mode of operation of the invention as herein disclosed, it should be noted that the mode of operation to be discussed involves the side seaming of pants panels. Applicant does not wish to limit the particular mode of operation since the side seaming of women'dresses, shirts, etc., would require a different sequence of steps. Additionally, other uses involving the handling of sheet material may require general modification but still remain within the scope of the invention as disclosed herein.

Initially the operator manually picks up two fabric panels or plies from a convenient storage table such as 30. Depending upon the amount of automatic auxiliary aids provided with the pants panel contour seamer assembly, the operator may thereafter follow either of two possible modes. In the event the overall device is provided with a top clamp assembly means, such as 36, and a transfer clamp means such as 50, as a device shown in FIG. 1, the operator manually matches the top side seam corners, then separates them and inserts them into the top clamp means. A switch is triggered and the top clamp closed. The matched middle or center side seams of the two panels are inserted into the transfer clamp means 50. It should be noted that in the event there are alignment notches in the fabric panels, in order to create fullness in the pants; for example, not only are the top corner edges aligned but these alignment notches are also clamped and held. The panels thus orientated with respect to each other are inserted into the transfer clamp and the transfer clamp is closed. It should be noted that any convenient system can be employed for closing and keeping engaged the various clamps, etc., employed with the invention as herein disclosed.

The top clamp assembly 36 then loads the matched top side seam corners, one under and one over the separator plate (not shown) of the guide means 26 and both under the presser foot (not shown) of the sewing machine 14. The transfer clamp assembly 50 acting simultaneously with the movement thereof, insets the mid section of both fabric panels into the alignment means 10. As previously stated, in the event it is desired to achieve fullness or for some other reason have midpoint alignment, alignment notches have been provided. For this purpose the intermediate clamp means such as 52 is also provided, generally adjacent the alignment means clamp 10. Switches are then activated whereby the midpoint clamp is closed and the alignment and sensing clamp is partially closed and the top clamp and transfer clamp are opened and returned to their initial position.

As was previously stated, the top clamp 36 and transfer clamp 50 could be manually performed by the operator. That is, she could manually align all of the respective corners, notches and seams and thereafter manually insert them into the various locations. As is apparent, this total method of operation will vary from job to job; that is, shirts will require different procedures from the side seaming of pants.

The presser foot of the sewing machine 14 as well as the edge guide means 26 are actuated very shortly after the series of clamps. Substantially simultaneously therewith, the alignment means support system means 100 is moved down the edge of the fabric plies. In contour seaming of pants; for example, the sweep or movement would be toward the lower corners of the fabric panels. Depending upon circumstances, necessity, etc., the side edges may be orientated in some predetermined manner as by the provision of the side edge guide means. The necessity of providing a means to orientate these panels will of course depend upon the process being performed, the particular nature of the fabric plies, etc. In the embodiment as disclosed herein, edge guide means, such as 241 and 243, are provided whereby the side edges of the fabric sheets are orientated in a predetermined manner. This insures that the bottom side seam corners will be matched as well, rather than only matching the bottom edges.

At some predetermined time as the end alignment means 10 approaches the bottom side edge of the fabric ply, the aligning sequence of events will be activated. Here again, it should be appreciated that the particular time and manner in which these events occur can be varied depending upon the operation to be performed, the nature of the material and the physical design of the assembly. In the embodiment of the invention, as herein disclosed, the end of the shorter of the fabric panels is first sensed. Simultaneously therewith this end is clamped in a known orientation. The elements of the clamping means, such as 143 or 147 are thus removably secured to the fabric panel. The other clamping means and associated elements continue to sweep down the length of the fabric panel. When the location of the second bottom side end is determined it is also clamped. Thereafter the two bottom edges are aligned or at least positioned in some predetermined mode.

In the embodiment as herein described, this is accomplished by actuating cylinder 107 which in turn exerts force on jaw means 143 and 147. Each jaw means is acted on independently by the springs 125 and 127 until both are flush against the face 123 of end 119. The springs are chosen such that their combined springs force is sufficient to resist further action by cylinder 107.

At this point in the cycle of the particular embodiment, the sewing machine assembly is activated and the side seams are joined. In the embodiment, as herein disclosed, once the bottom side seam corners are aligned no further alignment takes place during the sewing cycle. As is apparent, however, the alignment means 10, especially employing the ten element photo transistor means could be provided with an electrical circuitry assembly means which could continuously, during the sewing operation, monitor and realign the bottom side seam corners. This system would be particularly applicable in situations where the two plies of material, simply by virtue of their composition, would not feed at the same rate. As stated earlier, a top and bottom feed, feed dog system is employed in contour seaming machines. This insures that both the top and bottom plies will feed at substantially the same rate. Depending, however, upon these feeding and material perimeters the bottom side seam corners could be repeatedly aligned during the sewing cycle or simply at particular points, i.e., the midpoint of the sewing cycle.

Regardless of the sequence that the alignment means follows, generally the same events occur which would at the end of the cycle. That is, as the alignment means carrying the matched side seam corners approaches the sewing machine 14, the guide means 26 disengages itself from the fabric plies and moves physically, if necessary, to allow the matched bottom side seam corners to be fed directly into or under the presser foot assembly. Just prior to actual engagement of the alignment means 10 with the sewing machine 14, a switch means (not shown) can be triggered. This immediately causes the release of the fabric corners and the return of the alignment means 10 to the initial loading position. Thereafter the sewing machine assembly completes its normal cycle which includes the cutting of the chain and raising the presser foot. At this point, if it is so desired an automatic stacker assembly engages the fabric and places it or positions it in a predetermined manner.

Briefly, to recap the basic events which take place in the contour seaming of two pants panels wherein is incorporated the invention as described; first, the panels are inserted into the aligner means. Thereafter the aligner means sweeps down the fabric panels and forces the side edge of the panels against an edge guide, i.e., positions them in a predetermined mode.

Upon the sensing of the bottom edge of the shortest fabric panel a sequence of events transpires which include clamping, sensing and alignment in some particular order. Upon the alignment of the bottom edge in some predetermined form, the sewing machine is activated. Thereafter the top and bottom feed dogs of the sewing machine overcome the force of either gravity or other means to continually perform the stitching operation on the fabric plies. As is apparent, the panels are under some tension during this step. As the aligner means approaches the stitch forming instrumentality the assembly means disengages itself in the fabric and moves to a non-obstructing position. Just prior to physical contact of the aligner means with the sewing machine, the panels are released, the sewing machine completes its cycle and the aligner assembly means returns to the loading position.

Thus it is apparent that there has been provided, in accordance with the invention, an apparatus for orientating sheet means that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. Apparatus mounted for sweeping down the edges of said series of fabric panel means prior to the performance of a work cycle on said fabric panel means in combination with a sewing machine comprising:

means separately accepting side portion means of said fabric panel means;

means guiding a side portion means of said fabric panel means into a predetermined position when moved with respect to said fabric panel means;

means aligning bottom portion means of said fabric panel means whereby said fabric panel means are aligned in a predetermined position;

means for securing said fabric panel means in said predetermined position; and means for transporting said secured fabric panel means to a position adjacent said sewing machine.

2. The means for aligning corners of claim 1 wherein:

said means aligning bottom portion means follows said means for transporting, whereby aligning bottom portion of said fabric panel means during the work cycle of said sewing machine.

3. A contour seamer apparatus for joining two fabric ply means, including an edge guide means, a sewing machine means, fabric support means, a top clamp means, and an intermediate clamp means wherein the improvement comprises a fabric edge alignment means mounted for sweeping down the edges of said fabric ply means prior to the performance of a work cycle on said fabric ply means including:

means engaging first side portion means of said fabric ply means;

means acting on said first side portion means whereby the edge means when moved with respect to said fabric panel means are aligned during transport toward a second side portion means;

means sensing an edge portion means of said second side portion means;

means aligning the end portion means of second side portion in a predetermined manner; and means securing said fabric ply means in said aligned manner whereby said alignment can be maintained during the work cycle of said sewing machine means.

4. The fabric edge alignment means of claim 3 wherein:

said means aligning the end portion means and said means securing said aligned fabric means are carried on a transport means; and said aligning means secures the fabric panels bottom portion as said bottom portion approaches said sewing machine.

5. Apparatus mounted for sweeping down the edges of a series of fabric ply means prior to the performance of a work cycle on said fabric ply means comprising:

means accepting a first edge portion means of said fabric ply series including means for orientating said edge portion means when moved with respect to said fabric ply series;

means sensing the longer and shorter of a second edge portion means of said fabric series;

means aligning said second edge portion means in a predetermined manner; and means securing said first and second edge portion means in said predetermined manner during the performance of said work cycle.

6. The apparatus for aligning of claim 5 including:

means securing a third edge portion means whereby the alignment thereof is maintained; and means securing said fabric ply means at a midpoint thereof whereby the alignment thereof is maintained.

7. The apparatus of claim 5 wherein:

said means for sensing, upon sensing the longer and shorter of a second edge portion of said fabric panel means, transmits this information to the means securing, which secures the shorter fabric panel and to the mounting means which terminates sweeping the means for accepting side portion means along the side of said fabric panel means.

8. Apparatus for orientating sheet means in a predetermined position comprising:

means accepting a series of sheet means including an edge alignment and guiding means, and a mounting means, said mounting means sweeping said edge alignment and guiding means along a first edge means of said sheet means;

means for sensing a predetermined portion of a sheet means; and means for securing and moving a sheet means into a predetermined position with respect to the other sheet means.

9. The apparatus for orientating sheet means of claim 8 wherein:

said means for sensing includes a series of sensor means corresponding at least to the series of sheet means; and said means for securing and moving includes a series of securing means corresponding at least to the series of sheet means.

10. Apparatus for aligning the corners of a series of fabric panel means with respect to each other comprising:

means for accepting side portion means of said fabric panel means, including a means urging said side portion of said panel means into a predetermined position;

means for sensing a second side portion means of said fabric panel means;

means selectively securing said second side portion means and aligning them in a predetermined position; and mounting means carrying said means for accepting side portion means; said means for accepting adapted to be swept along the side of said fabric panel means.

11. The apparatus of claim 10 wherein:

said means for sensing a second side portion, senses first, the shortest of said fabric panel means and transmits this information to said means selectively securing which means immediately secures said shorter fabric panel.

* * * * *